US009038824B2

(12) United States Patent
Zhao

(10) Patent No.: US 9,038,824 B2
(45) Date of Patent: May 26, 2015

(54) PACKING BOX USED FOR ACCOMMODATION OF PLATE BODIES

(71) Applicant: Shenzhen China Star Optoelectronics Technology Co., Ltd., Shenzhen, Guangdong (CN)

(72) Inventor: Zhilin Zhao, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 233 days.

(21) Appl. No.: 13/703,351

(22) PCT Filed: Nov. 19, 2012

(86) PCT No.: PCT/CN2012/084813

§ 371 (c)(1),
(2) Date: Dec. 11, 2012

(87) PCT Pub. No.: WO2014/059724

PCT Pub. Date: Apr. 24, 2014

(65) Prior Publication Data

US 2014/0102941 A1 Apr. 17, 2014

(30) Foreign Application Priority Data

Oct. 17, 2012 (CN) ..... 2012 1 0395157

(51) Int. Cl.

| | |
|---|---|
| ***B65D 85/48*** | (2006.01) |
| ***B65D 81/02*** | (2006.01) |
| ***B65D 81/05*** | (2006.01) |

(52) U.S. Cl.
CPC ..... *B65D 81/02* (2013.01); *B65D 81/05* (2013.01); *B65D 85/48* (2013.01)

(58) Field of Classification Search
CPC ..... B65D 81/02; B65D 81/05; B65D 85/48
USPC ..... 206/449, 453–455, 521, 523, 586–594, 206/493, 706
See application file for complete search history.

(56) References Cited

U.S. PATENT DOCUMENTS

| | | | | |
|---|---|---|---|---|
| 3,701,465 | A * | 10/1972 | Richter | 206/521 |
| 5,076,432 | A * | 12/1991 | Wolf et al. | 206/449 |
| 5,447,234 | A * | 9/1995 | Faulstick et al. | 206/449 |
| 5,518,118 | A * | 5/1996 | Putz et al. | 206/449 |
| 5,593,039 | A * | 1/1997 | Ortlieb | 206/586 |
| 6,789,675 | B2 * | 9/2004 | Abe et al. | 206/449 |
| 7,571,808 | B2 * | 8/2009 | Kong et al. | 206/454 |
| 7,644,820 | B2 * | 1/2010 | Hohne et al. | 206/523 |
| 2005/0092645 | A1 * | 5/2005 | Arnold | 206/523 |
| 2008/0128310 | A1 * | 6/2008 | Kao et al. | 206/521 |

* cited by examiner

*Primary Examiner* — Luan K Bui

(57) ABSTRACT

The present invention relates to a packing box for accommodation of plate bodies, which comprises a backplane, and a side plate vertically arranged at the periphery of the backplane, the plate body including a main body, and a PCB plate connected through a flexible sheet to the edge of the main body, a positioning member being further arranged in the space enclosed by the backplane and the side plate for preventing the PCB plate from moving relative to the main body. The positioning member of the present invention can prevent the PCB plate from moving relative to the main body of the plate body, playing a role in protecting the circuit on the flexible sheet and having low costs.

3 Claims, 4 Drawing Sheets

PACKING BOX USED FOR ACCOMMODATION OF PLATE BODIES

FIELD OF THE INVENTION

The present invention relates to the packing structure of the electronic products, and more particularly to a packing box used for accommodation of the semi-finished liquid crystal display module.

BACKGROUND OF THE INVENTION

Currently, there is a variety of methods of packing the liquid crystal glass in the panel industry, including a blister tray as the main body, an injection molded box as the main body, and a foaming product as the main body. The liquid crystal glass has two forms, which are named in the industry respectively as CELL and Open CELL, wherein CELL is the most primitive liquid crystal glass not different from the common sheet glass in appearance, and the Open CELL, based thereon, is provided with various interfaces so as to be connected to the external signal source.

A general Open CELL may be connected to more than one PCB plates through a flexible sheet, which is called COF in the industry and provided with circuits all over in the middle to act as an important signal bridge between CELL and the PCB plate. Open CELL is generally placed flat into the box, which has positioning arrangement on all side for CELL; when the box is subject to vibration, the PCB plate is inclined to move with the vibration frequency, thus tearing COF, causing the circuit of COF to be damaged; alternatively, because COF is a flexible sheet, the PCB plate is inclined to be vibrated into the two pieces of CELL.

It was mentioned in the Chinese patent having an authorization notification number of CN 201068230Y that a support pole member can be inserted between CELL and COF, which can ensure that PCB is not brought into the two pieces of CELL while reducing displacement of PCB; however, this technical solution needs the support pole to be used together with the box body and has relatively higher costs.

CONTENTS OF THE INVENTION

Aiming at the above defects of the existing technology, the technical problem to be solved by the present invention is to provide a packing box used for accommodation of plate bodies.

The present invention adopts the following technical solution to solve its technical problem: A packing box used for accommodation of plate bodies is provided, comprising: a backplane, and a side plate vertically arranged at the periphery of the backplane, the plate body including a main body, and a PCB plate connected through a flexible sheet to the edge of the main body, a positioning member being further arranged in a space enclosed by the backplane and the side plate for preventing the PCB plate from moving relative to the main body.

The packing box used for accommodation of plate bodies according to the present invention, wherein the positioning member includes a first barrier and a second barrier, both of which are arranged in the gap between the main body and the PCB plate at both sides of the flexible sheet.

The packing box used for accommodation of plate bodies according to the present invention, wherein both the first barrier and the second barrier are a hollow barrel in shape.

The packing box used for accommodation of plate bodies according to the present invention, wherein the first barrier and the second barrier are connected with each other through a connecting plate.

The packing box used for accommodation of plate bodies according to the present invention, wherein the first barrier, the connecting plate, and the second barrier are molded integrally.

The packing box used for accommodation of plate bodies according to the present invention, wherein this packing box further includes an inner frame fitted for outline of the plate body.

The packing box used for accommodation of plate bodies according to the present invention, wherein the inner frame is provided with a crevice at a position corresponding to the gap between the main body and the PCB plate at both sides of the flexible sheet, the first barrier and the second barrier being inserted at their one side into the crevice and exposed at the other side at the crevice.

The packing box used for accommodation of plate bodies according to the present invention, wherein both the first barrier and the second barrier are hard sheets.

The packing box used for accommodation of plate bodies according to the present invention, wherein the hard sheets include an EVA sheet or a silica sheet.

The packing box used for accommodation of plate bodies according to the present invention, wherein the main body includes liquid crystal glass.

The packing box used for accommodation of plate bodies according to the present invention has the following beneficial effects: The positioning member of the present invention can prevent the PCB plate from moving relative to the main body of the plate body, playing a role in protecting the circuit on the flexible sheet and having low costs.

BRIEF DESCRIPTIONS OF THE DRAWINGS

The present invention will further be explained with reference to drawings and examples. In the drawings.

DETAILED DESCRIPTION OF THE EMBODIMENTS

Figure 1:
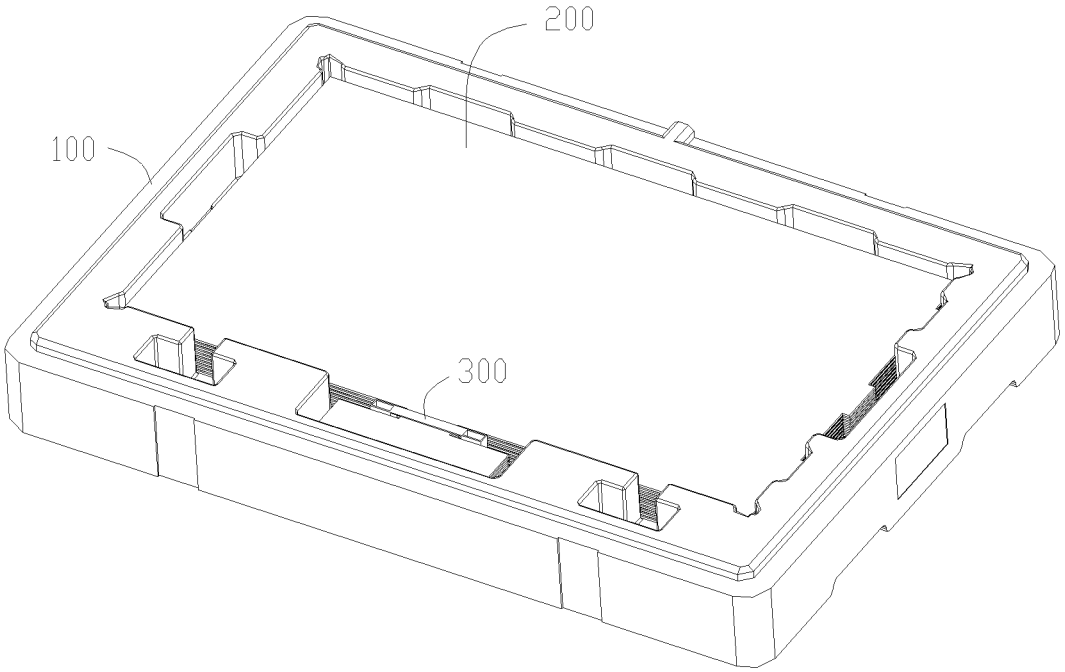
FIG. 1 is a structural schematic drawing of the first example of the packing box used for accommodation of plate bodies according to the present invention.
Figure 2:
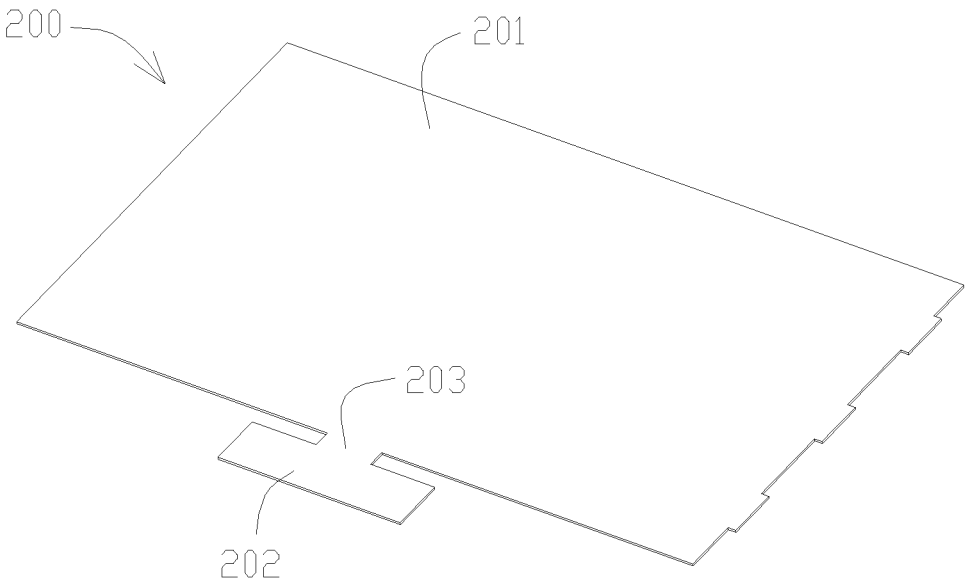
FIG. 2 is a structural schematic drawing of the plate body of the first example of the packing box used for accommodation of plate bodies according to the present invention.

As shown in FIG. 1, in the first example of the present invention, this packing box used for accommodation of plate bodies comprises a backplane 100, and a side plate 101 vertically arranged at the periphery of the backplane 100; as shown in FIG. 2, the plate body 200 includes a main body 201, and a PCB plate 202 connected through a flexible sheet 203 to the edge of the main body 201; the flexible sheet 203 is a connecting sheet covered with circuits, and plays a role in transferring signals between the main body 201 and the PCB plate 202. A positioning member 300 is further arranged in a space enclosed by the backplane 100 and the side plate 101 for preventing the PCB plate 202 from moving relative to the main body 201. In this example, the positioning member 300 includes a first barrier 301 and a second barrier 302, both of which are arranged in the gap between the main body 201 and the PCB plate 202 at both sides of the flexible sheet 203, thus preventing the PCB plate 202 from moving relative to the main body 201.

Figure 3:
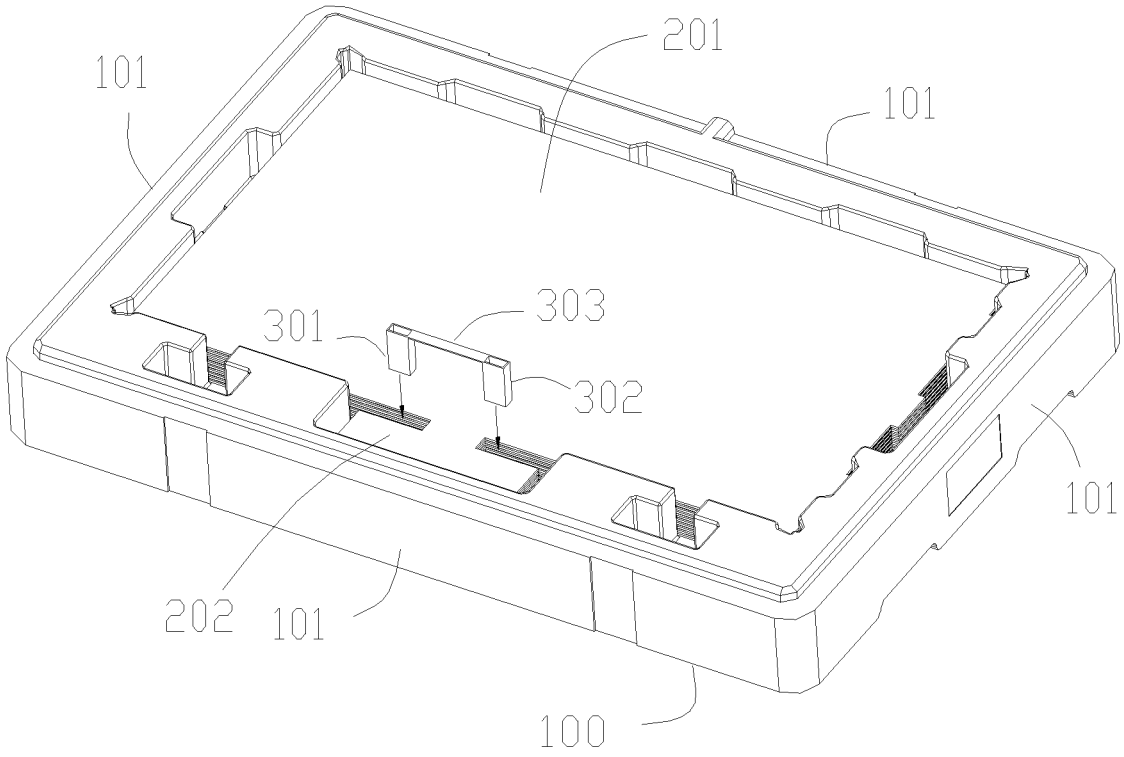
FIG. 3 is a structural exploded drawing of the first example of the packing box used for accommodation of plate bodies according to the present invention.
Figure 4:
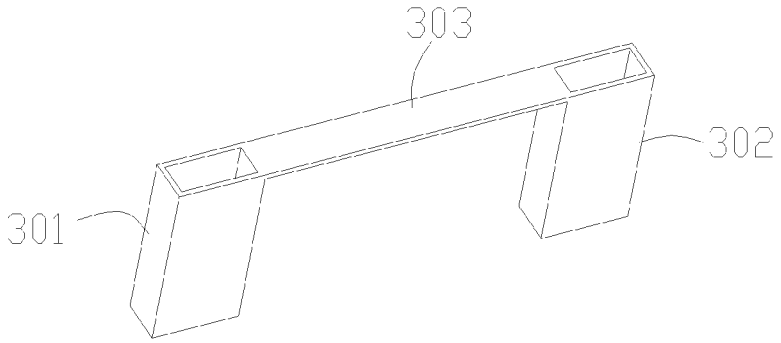
FIG. 4 is a structural schematic drawing of the positioning member of the first example of the packing box used for accommodation of plate bodies according to the present invention.

Preferably, as shown in FIGS. 3 and 4, both the first barrier 301 and the second barrier 302 are a hollow barrel in shape; further, the first barrier 301 and the second barrier 302 can also be connected with each other through a connecting plate 303, or made into a whole. Making the first barrier 301 and the second barrier 302 hollow can reduce the weight of the first barrier 301 and the second barrier 302, apply no pressure to the flexible sheet, and play a role in protecting the circuit on the flexible sheet, with the cost also reduced.

Figure 5:
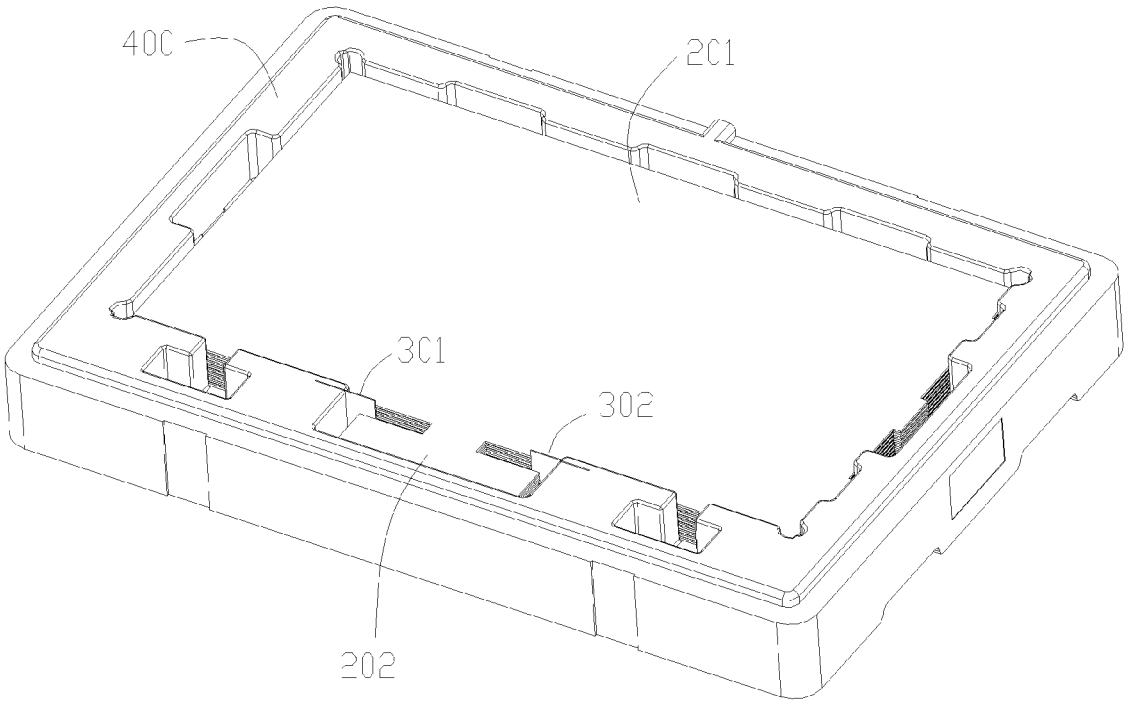
FIG. 5 is a structural schematic drawing of the second example of the packing box used for accommodation of plate bodies according to the present invention.
Figure 6:
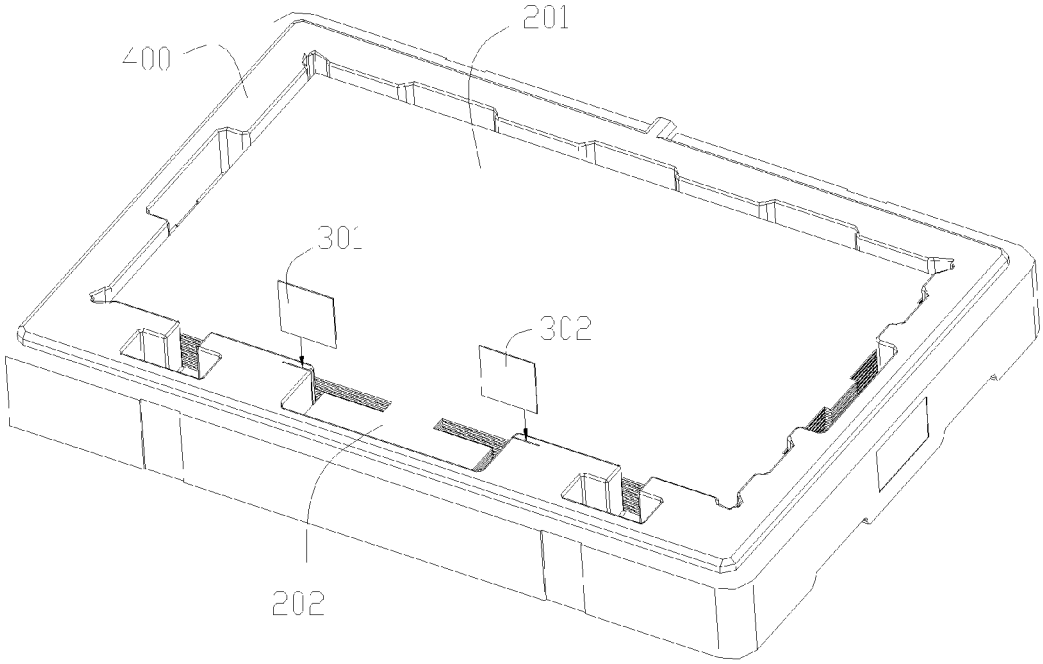
FIG. 6 is a structural exploded drawing of the second example of the packing box used for accommodation of plate bodies according to the present invention.

As shown in FIGS. 5 and 6, in the second example of the present invention, the components and functions of this packing box are basically the same with those in the last example, with the difference in that in this example this packing box further includes an inner frame 400 fitted in shape for the outline of the plate body 200, which is more advantageous to positioning of the plate body 200, and the structure of the positioning member 300 is also changed.

In this example, both the first barrier 301 and the second barrier 302 are hard sheets. The inner frame 400 is provided with a crevice at a position corresponding to the gap between the main body 201 and the PCB plate 202 at both sides of the flexible sheet 203, the first barrier 301 and the second barrier 302 being inserted at their one side into the crevice and exposed at the other side at the crevice, and being placed between the main body 201 and the PCB plate 202 for preventing them from moving relatively.

Preferably, the hard sheets used for manufacturing the first barrier 301 and the second barrier 302 can be an EVA sheet or a silica sheet.

In each of the above preferred examples, the main body 201 of the plate body 200 mainly refers to the liquid crystal glass.

The above examples are used only for explaining the technical concept and features of the present invention. They are provided to make those skilled in the art understand the present invention and implement it, and cannot thereby limit the extent of protection of the present invention. Any equivalent alteration and modification within the scope of the claims of the present invention shall fall within the scope of the claims of the present invention.

The invention claimed is:

1. A packing box used for accommodation of plate bodies, comprising a backplane, a side plate vertically arranged at the periphery of the backplane and a positioning member arranged in a space enclosed by the backplane and the side plate, wherein each of the plate bodies includes a main body, Printed Circuit Board and a flexible sheet; the main body and the Printed Circuit Board are connected to two opposite sides of the flexible sheet respectively, thus two gaps at the other two opposite sides of the flexible sheet are respectively defined between the main body and the Printed Circuit Board; and the positioning member includes a first barrier, a second barrier parallel to the first barrier, and a connecting plate respectively connected to top surfaces of the first and second barriers; the first and second barriers are a hollow barrel in shape and are respectively arranged in the two gaps for preventing the Printed Circuit Board from moving toward the main body.

2. The packing box used for accommodation of plate bodies according to claim 1, characterized in that the first barrier, the connecting plate, and the second barrier are molded integrally.

3. The packing box used for accommodation of plate bodies according to claim 1, characterized in that the main body includes liquid crystal glass.

* * * * *